US010343805B2

(12) United States Patent
Woehl

(10) Patent No.: US 10,343,805 B2
(45) Date of Patent: Jul. 9, 2019

(54) ARTICLE SELECTION AND PACKAGING SYSTEM

(71) Applicant: Brenden Michael Woehl, Wyoming, MN (US)

(72) Inventor: Brenden Michael Woehl, Wyoming, MN (US)

( * ) Notice: Subject to any disclaimer, the term of this patent is extended or adjusted under 35 U.S.C. 154(b) by 351 days.

(21) Appl. No.: 15/254,676

(22) Filed: Sep. 1, 2016

(65) Prior Publication Data

US 2017/0057675 A1 Mar. 2, 2017

Related U.S. Application Data

(60) Provisional application No. 62/212,929, filed on Sep. 1, 2015.

(51) Int. Cl.

| | |
|---|---|
| ***B65B 5/08*** | (2006.01) |
| ***B65B 5/12*** | (2006.01) |
| ***B65B 21/12*** | (2006.01) |
| ***B65B 21/18*** | (2006.01) |
| ***B65B 65/00*** | (2006.01) |

(52) U.S. Cl.

CPC ..... *B65B 65/006* (2013.01); *B65B 5/08* (2013.01); *B65B 21/12* (2013.01); *B65B 21/18* (2013.01); *B65B 5/12* (2013.01); *B65B 2220/14* (2013.01)

(58) Field of Classification Search

CPC ..... B65B 65/006
USPC ..... 53/443
See application file for complete search history.

(56) References Cited

U.S. PATENT DOCUMENTS

| | | | | |
|---|---|---|---|---|
| 5,996,316 | A * | 12/1999 | Kirschner | B65G 1/1378 53/155 |
| 6,067,772 | A * | 5/2000 | Kraft | B65B 5/101 53/240 |
| 6,907,979 | B2 * | 6/2005 | Ford | B65B 35/30 198/419.3 |
| 7,743,587 | B2 * | 6/2010 | Hagenbrock | B65B 21/12 53/171 |
| 2008/0229713 | A1 * | 9/2008 | Ford | B65B 21/06 53/443 |
| 2009/0266732 | A1 * | 10/2009 | Hartl | B65D 71/08 206/432 |
| 2010/0043355 | A1 * | 2/2010 | Duperray | B65B 5/06 53/443 |

* cited by examiner

*Primary Examiner* — Lori L Baker
(74) *Attorney, Agent, or Firm* — Schwegman Lundberg & Woessner, P.A.

(57) ABSTRACT

An article selection and packing system includes at least two article housing stations and a composite article housing station spaced from the at least two article housing stations. A boom extends over the at least two article housing stations and the composite article housing station. A selection and packing assembly extends between the at least two article housing stations and the composite article housing station. The selection and packing assembly includes at least two telescoping shuttles, the at least two telescoping shuttles are movably coupled along the boom. At least two grasping assemblies coupled with the at least two telescoping shuttles, respectively. The at least two grasping assemblies are each configured to withdraw one or more articles from the at least two article housing stations, respectively, and pack the withdrawn one or more articles together at the composite article housing station.

28 Claims, 7 Drawing Sheets

ARTICLE SELECTION AND PACKAGING SYSTEM

PRIORITY

This application claims the benefit of Provisional Application Ser. No. 62/212,929, filed Sep. 1, 2015, which application is incorporated by reference herein its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Brenden M. Woehl, Wyoming, Minn., USA. All Rights Reserved.

TECHNICAL FIELD

This document pertains generally, but not by way of limitation, to selection of articles and packing of articles in an article container.

BACKGROUND

Articles, such as beverages, containers, enclosed goods and the like, are often packed into housings, such as containers, crates or the like. In some examples identical articles are packed into the housings for shipping, distribution and sale. In other examples, two or more different types of articles are packed into a housing, for instance to form a variety pack of articles. The variety pack of articles is purchased by customers because of the differing types of articles therein. One example of a variety pack of articles includes a housing containing a plurality of differing beverage articles (e.g., soft drinks, beer, or the like).

In one example, a variety pack of articles is assembled by manually opening a plurality of article housings (e.g., beer cases), hand picking one or more beverages from each of the article housings and then repacking the picked beverages in an open housing. The laborer is given instructions on how many of each type of beverage are specified for the opening housing.

In other examples, a machine orients and reorients a packing head that is moved over conveyor delivered containers (e.g., containers delivered from a production line) to pick and pack the containers in a mixed package. The packing head includes plural modules, and each of the modules includes receptacles for containers. The packing head then rotates to place the modules and picked containers in the mixed package. Optionally, the packing head rotates the modules relative to each other for placement of the containers in the mixed package.

OVERVIEW

The present inventors have recognized, among other things, that a problem to be solved can include decreasing manual labor for repacking of articles into composite article housings, e.g., variety packs. As discussed herein, in some examples variety packs of differing articles are packed by manually picking articles from two or more housings and then repacking the picked articles in a single housing. Workers select and pick the articles and then repack the articles in the single housing. This process is labor intensive, time consuming and prone to human error (e.g., packing of improper articles, an incorrect mix of articles or the like).

The present subject matter can help provide a solution to this problem, such as by using an article selection and packing system. The system includes a boom and selection packing assembly having at least two telescoping shuttles coupled along the boom. Grasping assemblies are associated with each of the telescoping shuttles. The grasping assemblies withdraw one or more articles from two or more article housing stations each having an article housing (e.g., cases of beverage containers). The telescoping shuttles are telescopically gathered and correspondingly gather the grasping assemblies and the withdrawn articles. The gathered articles are delivered to a composite article housing in the gathered configuration. The article selection and packing system automates the selection and withdrawal of articles and precisely repackages the selected articles in a composite article housing. The grasping assemblies are optionally selectively operated to withdraw articles from each of the article housing stations according to a specified mixture of differing articles in the composite article housing. The system minimizes manual labor, and accordingly decreases the time needed to fill the composite article housing while also minimizing errors (e.g., packing of an incorrect combination of articles).

Another problem to be solved can include minimizing complex actuators and robotic mechanisms used to manipulate automated packing heads and discrete modules of packing heads for orientation and reorientation of the same during picking and packing. As discussed herein, in some examples a robotic packing head with a plurality of actuators configured to move the packing ahead, rotate modules of the packing head and orient modules is provided for packing articles in containers. In at least some examples these systems are technically complex and use multiple actuators, sensors and like to select, withdraw, reorient and deliver articles to a container. Such systems are expensive and can require significant investment that warrants their use in high production environments (e.g., breweries, soft drink factories or the like).

The present subject matter can help provide a solution to this problem, such as by using an article selection and packing system. The telescoping shuttles of the system are used in combination with a drive mechanism, such as an endless belt or chain to telescopically gather and spread apart the shuttles and the grasping assemblies associated with each of the shuttles. The telescoping shuttles are sized and assembled to ensure accurate spacing of the grasping assemblies relative to each other while also ensuring accurate positioning relative to each of two or more article housing stations (e.g., stations with cases of beverage containers ready for repacking). After withdrawing the specified articles from each of the article housing stations the movement of the drive mechanism in combination with the shuttles telescopically gathers the shuttles, gathers the articles and positions the gathered articles in alignment with a composite article housing station (e.g., a variety pack container) for delivery, for instance by lowering of the grasping assemblies. The article selection and packing system minimizes the number of actuators for the systems and instead uses telescoping shuttles in combination with the drive mechanism to reliably withdraw a variety of articles and repack the articles in the composite article housing.

This overview is intended to provide an overview of subject matter of the present patent application. It is not intended to provide an exclusive or exhaustive explanation of the invention. The detailed description is included to provide further information about the present patent application.

DETAILED DESCRIPTION

The article selection and packing system described herein is configured to assemble a variety pack of two or more differing articles (e.g., differing flavors of beverages, differing containers of beverages, differing types of articles or the like).

Article housings (e.g., trays, plastic crates, cardboard cases, boxes, containers or the like) holding consistent articles (e.g., the same type of articles) are loaded onto one of several conveyors or transfer devices and are moved into article housing stations for selection and repacking to a composite article housing. Optionally, the article housings are manually loaded into the article housing stations. The composite article housing is optionally an empty beverage case (or another type of container) that will hold the assembled variety package. As shown herein, the composite article housing is moved into a composite article housing station (e.g., manually, on a conveyor or the like).

With the article housings and the composite article housing in position, the articles of the housings are aligned with a plurality of grasping assemblies suspended from a boom. Several grasping assemblies located directly above the article housings in spread positions are lowered and withdraw a specified number of articles (e.g., beverage containers) from each of the article housings simultaneously, the grasping assemblies are raised relative to the article housings (e.g., by raising of the boom) with the selected articles coupled to the grasping assemblies. In the elevated position, the grasping assemblies above the article housings stations translate laterally toward the composite article housing station and the composite article housing. The grasping assemblies are stacked (e.g., side-by-side) relative to their spread positions above the article housings. The grasping assemblies and withdrawn articles are gathered together above the composite article housing for delivery to the composite article housing. The grasping assemblies with the articles descend (e.g., through descent of the boom) toward the composite article housing and the articles are delivered to the composite article housing. The grasping assemblies are elevated and then spread apart into a selection configuration with each of the grasping assemblies positioned above its associated article housing station. The process is then repeated to continue filling of the composite article housing and form the variety pack, or one or more of a new composite article housing or article housings are positioned at the respective article stations to supply more articles or fill another composite article housing.

Figure 1:
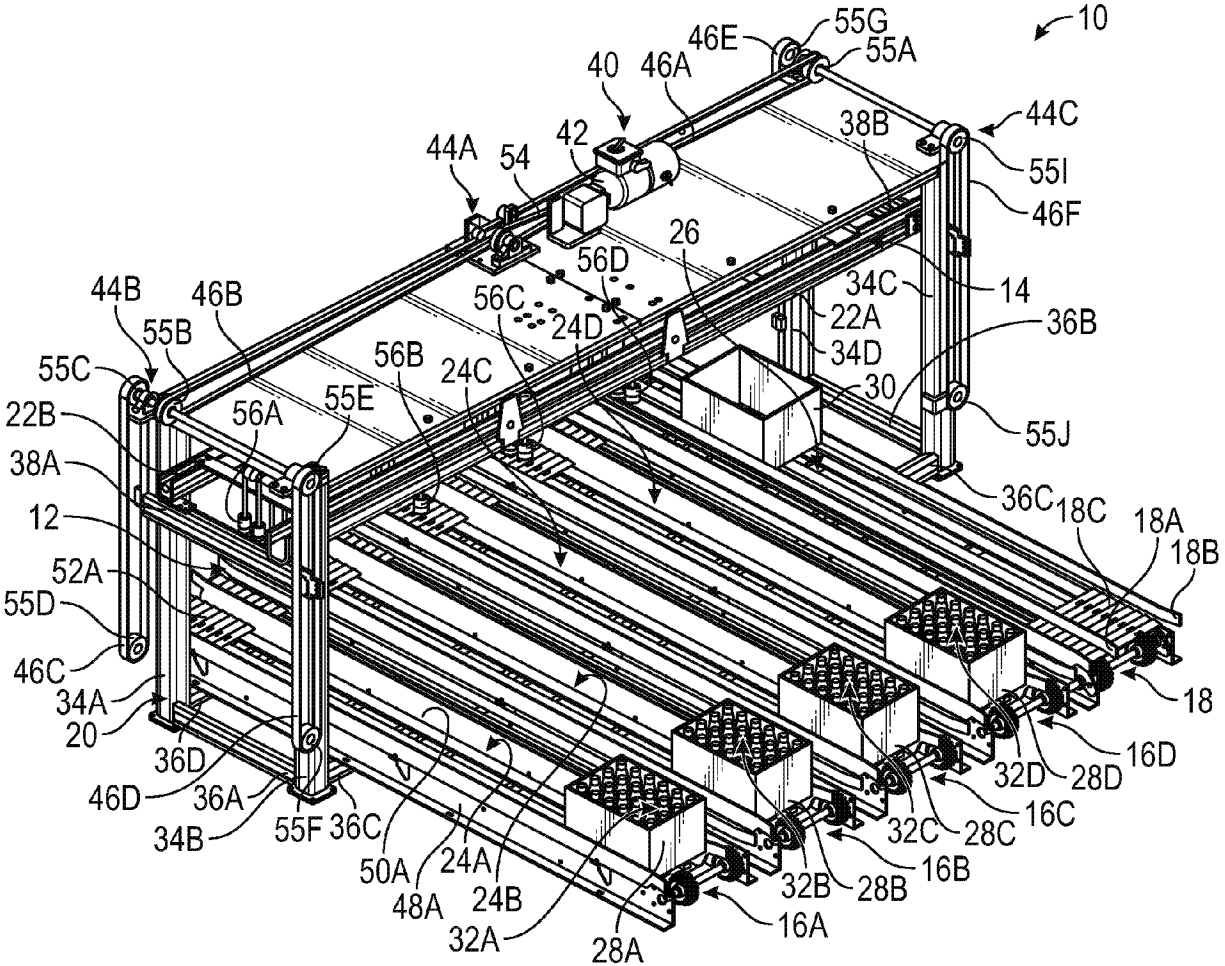
FIG. 1 is a perspective view of an article selection and packing system having a selection and packaging assembly connected to a boom system disposed relative to a plurality of article housing conveyers and a composite article housing conveyor.

FIG. 1 is a perspective view of an example article selection and packing system 10 having an example selection and packaging assembly 12 connected to boom system 14 disposed relative to article housing conveyers 16A, 16B, 16C and 16D, and composite article housing conveyer 18. In an example, boom system 14 includes boom frame 20 and boom 22, which includes spans 22A and 22B. Article housing conveyers 16A, 16B, 16C and 16D are disposed relative to boom system 14 to form article housing stations 24A, 24B, 24C and 24D where selection and packaging assembly 12 can access article housings 28A-28D. For example, spans 22A and 22B are disposed above article housing conveyers 16A, 16B, 16C and 16D and extend transverse to the longitudinal axes of article housing conveyers 16A, 16B, 16C and 16D. Composite article housing conveyer 18 is disposed relative to boom system 14 to form composite article housing station 26 where selection and packaging assembly 12 can access composite article housing 30. For example, spans 22A and 22B are located above composite article housing conveyer 18 and extend transverse to the longitudinal axis of composite article housing conveyer 18. Article housings 28A, 28B, 28C and 28D are disposed on article housing conveyers 16A, 16B, 16C and 16D, respectively. Composite article housing 30 is disposed on composite article housing conveyer 18. Article housings 28A, 28B, 28C and 28D include a plurality of articles 32A, 32B, 32C and 32D, respectively.

Article housings 28A-28D include, but are not limited to, containers, such as cardboard beverage boxes or the like, with an interior space that is accessible from at least one side of the containers (e.g. the top, such as by opening of folding flaps). However, any top-accessible housing may be used with article selection and packing system 10. As discussed, all of the articles 32A in article housing 28A are in one example of the same variety, e.g., each article 32A is a first type or flavor of beverage; all of the articles 32B in article housing 28B are in one example of the same variety, e.g., each article 32B is a second type or flavor of beverage; all of the articles 32C in article housing 28C are in one example of the same variety, e.g., each article 32C is a third type or flavor of beverage; and all of the articles 32D in article housing 28D are in one example of the same variety, e.g., each article 32D is a fourth type or flavor of beverage. In an example, the first, second, third and fourth types or flavors are different from each of the others. Selection and packaging assembly 12 of article selection and packing system 10 is used to select one or more of articles 32A-32D from article housings 28A-28D for packing in composite article housing 30 to form a variety pack, as is discussed in greater detail below.

Boom frame 20 comprises a system that permits selection and packaging assembly 12 to move grasping assemblies 56A, 56B, 56C and 56D relative to article housings 28A-28D and composite article housing 30. For example, boom frame 20 can move up and down (relative to the orientation of FIGS. 1-7). However, in various examples, boom frame 20 can move in other directions relative to article housing stations 24A, 24B, 24C and 24D and composite article housing station 26, such as side-to-side.

In an example, boom frame 20 includes posts 34A, 34B, 34C and 34D, which are connected together with stabilizer members 36A, 36B, 36C and 36D. Spans 22A and 22B of boom 22 are coupled to posts 34A-34D via side rails 38A and 38B. Side rails 38A and 38B are driven to slide along posts 34A-34D via elevator system 40, which includes elevator motor 42, pulley systems 44A, 44B and 44C, and belts 46A, 46B, 46C, 46D, 46E and 46F in an example, although other types of elevator mechanisms may be used. Pulley systems 44A-44C are operated to raise and lower boom 14 relative to article housing conveyers 16A, 16B, 16C and 16D, and composite article housing conveyer 18. In other embodiments, elevator system 40 may have other configurations, such as including telescoping posts, hydraulic or pneumatic posts, and the like, rather than pulley and belt systems. In other embodiments, elevator mechanisms other than elevator system 40, may be configured to raise and lower grasping assemblies 56A-56D directly without the use of boom 22.40

Article housing conveyors 16A-16D each include components for guiding article housings 28A-28D to article housing stations 24A-24D, respectively. For example, article housing conveyor 16A includes sidewalls 48A and 50A and belt 52A, although other configurations may be used. Article housing conveyors 16B-16D include similar components as article housing conveyor 16A in some examples. Composite article housing conveyor 18 includes sidewall 18A, sidewall 18B and belt 18C disposed along composite article housing station 26. Each belt 52A and 18C is configured to move in a longitudinal direction (with reference to the lengths of article housing stations 24A-24D and composite article housing station 26) between respective sidewalls to move article housings 28A-28D and composite article housing 30 from a first side of boom frame 20 to a second side of boom frame 20. Note that only portions of belts 52A and 18C are shown in FIG. 1, but that each belt described forms an endless loop such that the belts may continuously rotate around ends of the respective station to transport article housings 28A-28D and composite article housing 30, when desired. In particular, article housing conveyors 16A-16D move article housings 48A-48D relative to grasping assemblies 56A, 56B, 56C and 56D of selection and packing assemblies 12, as will be discussed in greater detail below. Each belt 52A and 18C is driven, such as by a motor, to automate movement of article housings 28A-28D and composite article housing 30 through each of article housing stations 24A-24D and composite article housing station 26.

As further shown in FIG. 1, boom 22 is raised and lowered to move grasping assemblies 56A-56D toward and away from article housings 28A-28D. In one example, elevator motor 42 is operated to raise and lower boom 22, for instance, via belts 46A, 46B, 46C, 46D, 46E and 46F. Elevator motor 42 may comprise any suitable motor or device for providing motion to pulley system 44A, such as a reversible motor configured to power drive pulley system 44A in first and second opposed directions. For example, elevator motor 42 may comprise an electric, pneumatic or hydraulic motor. In particular, belt 54 is used to rotate pulley system 44A with elevator motor 42. Pulley system 44A includes pulleys that drive belts 46A and 46B, and belts 46A and 46B drive pulleys 55A and 55B of pulley systems 44B and 44C. Pulley system 44B includes pulleys 55C, 55D, 55E and 55F to drive belts 46C and 46D. Pulley system 44C includes pulleys 55G, 55H (obscured in FIG. 1), 55I and 55J to drive belts 46E and 46F. Belts 46C and 46D are connected to side rail 38A. Belts 46E and 46F are connected to side rail 38B of boom 22. Thus, as elevator motor 42 rotates in a first direction, belts 46C-46F operate to move boom 22 (e.g., connected via side rails 38A and 38B) in an upward direction, and as elevator motor 42 rotates in a second direction, opposite the first direction, belts 46C-46F operate to move boom 22 (e.g., connected via side rails 38A and 38B) in a downward direction. As discussed in greater detail with reference to FIGS. 2-6, boom system 14 is connected to a plurality of grasping assemblies, such as grasping assemblies 56A-56D, that are used to retract selected articles 32A-32D from article housings 28A-28D as boom 22 is lowered and raised for packing of the selected articles into composite article housing 30 as shuttles of selection and packing assembly 12 expands and contracts telescopically between spans 22A and 22B.

Figure 2:
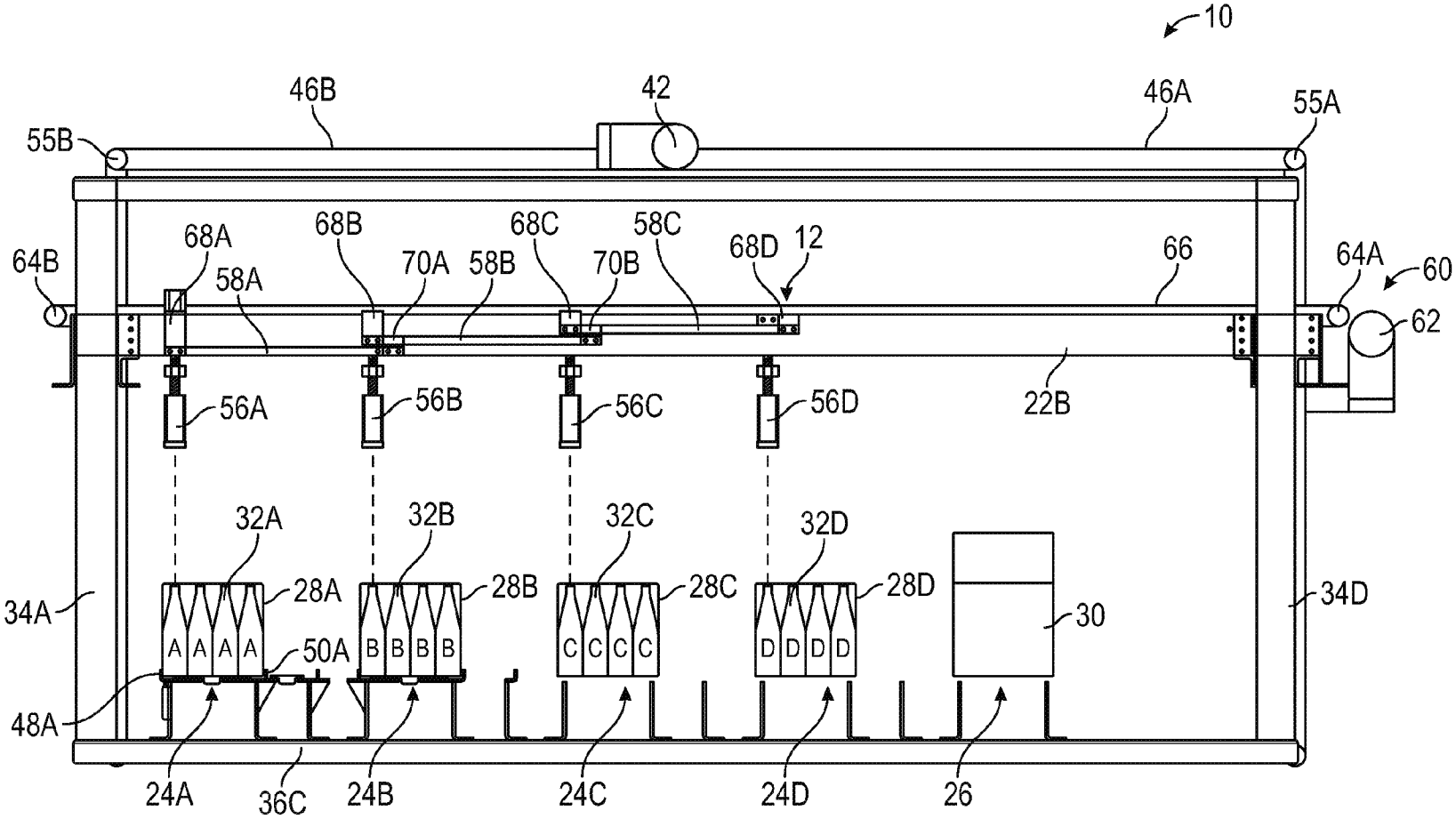
FIG. 2 is a front schematic view of the article selection and packaging system of FIG. 1 showing the selection and packaging assembly having a plurality of grasping assemblies connected to a plurality of telescoping shuttles that are movable relative to the boom system via a drive mechanism.

FIG. 2 is a front schematic view of article selection and packaging system 10 of FIG. 1 showing selection and packing assembly 12 having grasping assemblies 56A, 56B, 56C and 56D connected to a plurality of telescoping shuttles, such as telescoping shuttles 58A, 58B and 58C, that are movable relative to boom 22 via drive mechanism 60. Drive mechanism 60 comprises a system for allowing selection and packing assembly 12 to move relative to boom system 14. For example, drive mechanism 60 moves telescoping shuttles 58A, 58B and 58C side-to-side relative to boom system 14 (e.g., relative to spans 22A and 22B). Drive mechanism 60, in an example, includes drive motor 62, drive mechanism pulleys 64A and 64B and drive mechanism conveyor 66. Drive motor 62 is configured to rotate drive mechanism pulley 64A, which causes drive mechanism conveyor 66 to rotate, using drive mechanism pulley 64B. Drive motor 62 may comprise any suitable motor or device for providing motion to telescoping shuttles 58A-58C, such as a reversible motor configured to power drive mechanism conveyor 66 in first and second opposed directions. For example, drive motor 62 may comprise an electric, pneumatic or hydraulic motor. Drive mechanism conveyor 66 comprises any suitable device for attaching to grasping assemblies 56A-56D and pushing and pulling the grasping assemblies 56A-56D toward and away from composite article container 30 in a lateral direction perpendicular to the aforementioned longitudinal direction. For example, suitable examples of drive mechanism conveyor 66 include a chain, belt cable, extending member and the like. Drive mechanism 60 can utilize other systems and components for providing movement of grasping assemblies 56A-56D in other examples.

Telescoping shuttles 58A, 58B and 58C comprise support members or arms that permit grasping assemblies 56A-56D to be spaced apart (e.g. extended) and gathered or bunched (e.g., contracted) via selection and packaging assembly 12. In an example, telescoping shuttles 58A, 58B and 58C are connected to drive mechanism conveyor 66 via shuttle hitches 68A, 68B, 68C and 68D. Also, in an example, telescoping shuttles 58A and 58B are telescopically coupled via shuttle coupler 70A, and telescoping shuttles 58B and 58C are telescopically coupled via shuttle coupler 70B. Telescoping shuttles 58A-58C are illustrated in FIG. 2 in an extended or telescopically spread configuration.

In an example, following telescoping shuttle 58C is suspended directly from drive mechanism conveyor 66 via following shuttle hitches 68C and 68D; following telescoping shuttle 58B is suspended directly from drive mechanism conveyor 66 via following shuttle hitch 68C and suspended directly from following telescoping shuttle 58C via following shuttle coupler 70B; and leading telescoping shuttle 58A is suspended directly from drive mechanism conveyor 66 via leading shuttle hitch 68A and suspended directly from following telescoping shuttle 58B via following shuttle coupler 70A. However, in other embodiments, telescoping shuttles 58C, 58B and 58A can be directly or indirectly suspended from drive mechanism conveyor 66 by other methods and connections.

In other words, in an example, following telescoping shuttle 58C is directly coupled to, or suspended from, drive mechanism conveyor 66 via following shuttle hitches 68C and 68D; following telescoping shuttle 58B is directly coupled to, or suspended from, drive mechanism conveyor 66 via following shuttle hitch 68B and following telescoping shuttle 58C via following shuttle coupler 70B; and leading telescoping shuttle 58A is directly coupled to, or suspended from, drive mechanism conveyor 66 via leading shuttle hitch 68A and following telescoping shuttle 58B via following shuttle coupler 70A.

In the illustrated example, leading shuttle hitch 68A is fixedly or statically attached to drive mechanism conveyor 66 so as to move as drive mechanism conveyor 66 is pushed and pulled via drive mechanism motor 62. Thus, as drive mechanism motor 62 rotates in a first direction, drive mechanism conveyor 66 moves in a first direction, and as drive mechanism motor 62 rotates in a second direction, drive mechanism conveyor 66 moves in a second opposite direction. For example, drive mechanism conveyor 66 pulls leading shuttle hitch 68A to the right (with reference to the orientation of FIGS. 2-6), which causes leading telescoping shuttle 58A to move to the right. Following shuttle coupler 70A slides on following telescoping shuttle 58B (while drive mechanism conveyor 66 slides inside following shuttle hitch 68B) until leading shuttle hitch 68A engages following shuttle hitch 68B or following shuttle coupler 70A engages following shuttle hitch 68C. At which point, leading telescoping shuttle 58A and following telescoping shuttle 58B move rightward, with following shuttle hitch 68B moving with drive mechanism conveyor 66 and following shuttle coupler 70B sliding on following telescoping shuttle 58C (while drive mechanism conveyor 66 slides inside following shuttle hitch 68C). Following telescoping shuttle 58B moves rightward until following shuttle hitch 68B engages following shuttle hitch 68C or following shuttle coupler 70B engages following shuttle hitch 68D. At which point, leading telescoping shuttle 58A, following telescoping shuttle 58B and following telescoping shuttle 58C move rightward, with following shuttle hitches 68B, 68C and 68D moving with drive mechanism conveyor 66.

Figure 5:
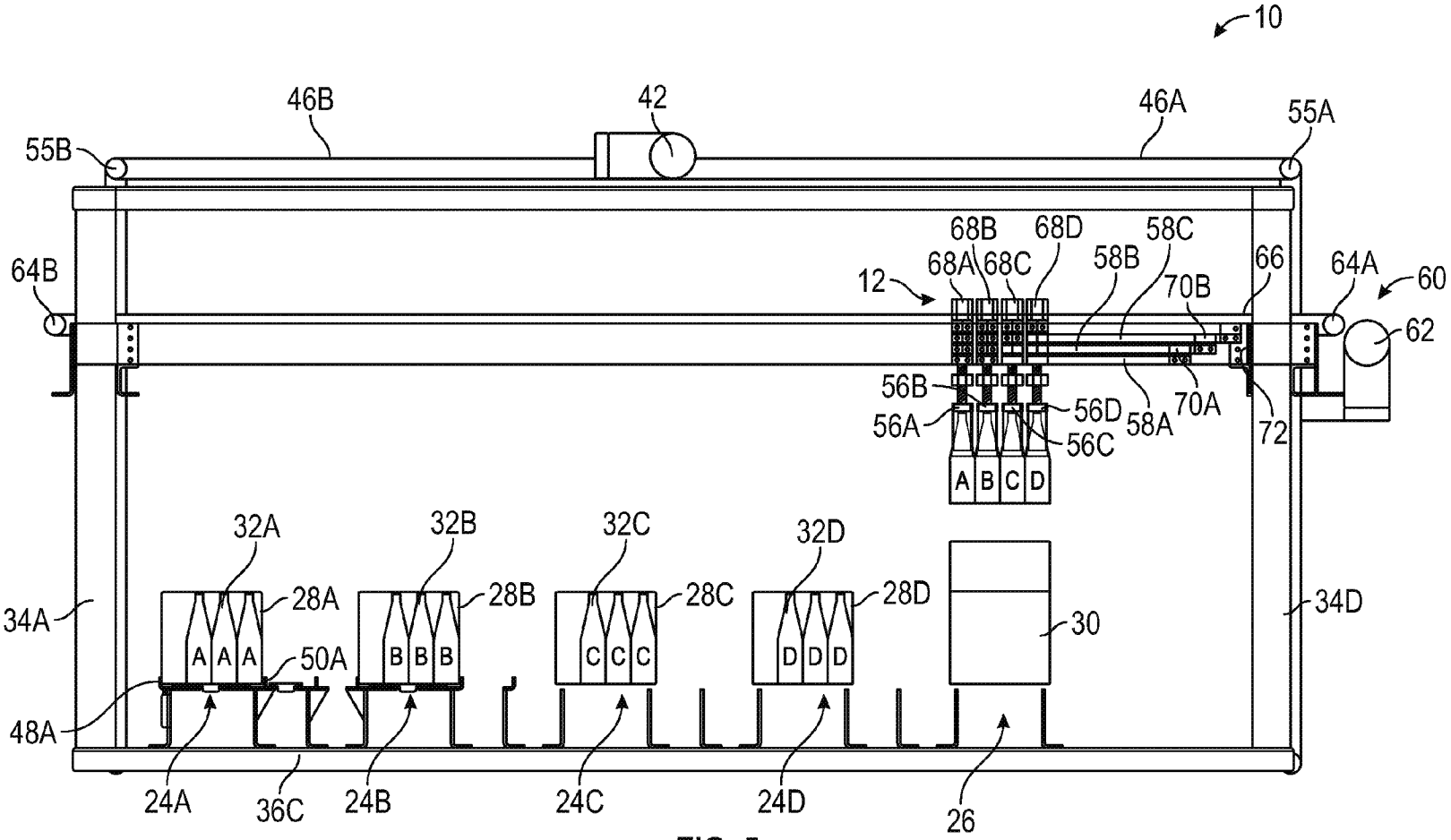
FIG. 5 is a front schematic view of the article selection and packaging system of FIG. 4 showing the plurality of telescoping shuttles retracted over a composite article housing disposed on the composite article housing conveyor.
Figure 6:
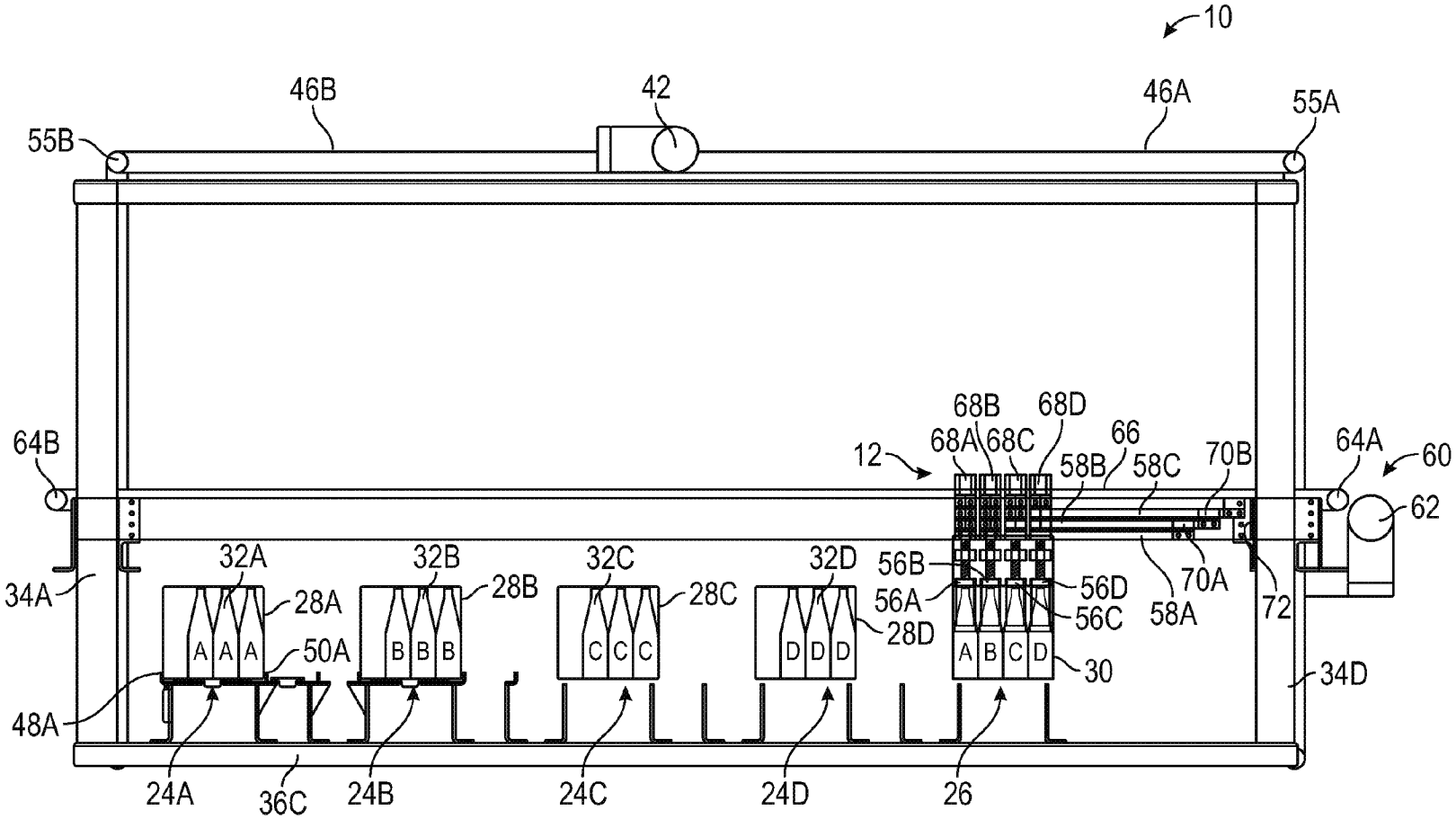
FIG. 6 is a front schematic view of the article selection and packaging system of FIG. 5 showing the boom lowered to place the selected articles in the composite article housing.

To reverse the process, from the fully retracted position (as shown in FIG. 6), drive mechanism conveyor 66 pushes leading shuttle hitch 68A to the left (with reference to the orientation of FIGS. 2-6), which causes leading telescoping shuttle 58A to move to the left. Leading telescoping shuttle 58A withdraws from following telescoping shuttle 58B until shuttle coupler 70A engages following shuttle hitch 68B, at which point following telescoping shuttle 58B begins to move to the left along with leading telescoping shuttle 58A. Following shuttle 58B withdraws from following telescoping shuttle 58C until shuttle coupler 70B engages following shuttle hitch 68C, at which point following telescoping shuttle 58C begins to move to the left along with leading telescoping shuttle 58A and following telescoping shuttle 58B. Telescoping shuttles 58A-58C move to the left until they reach the position of FIG. 3 above one of article housing stations 24A-24D.

Figure 3:
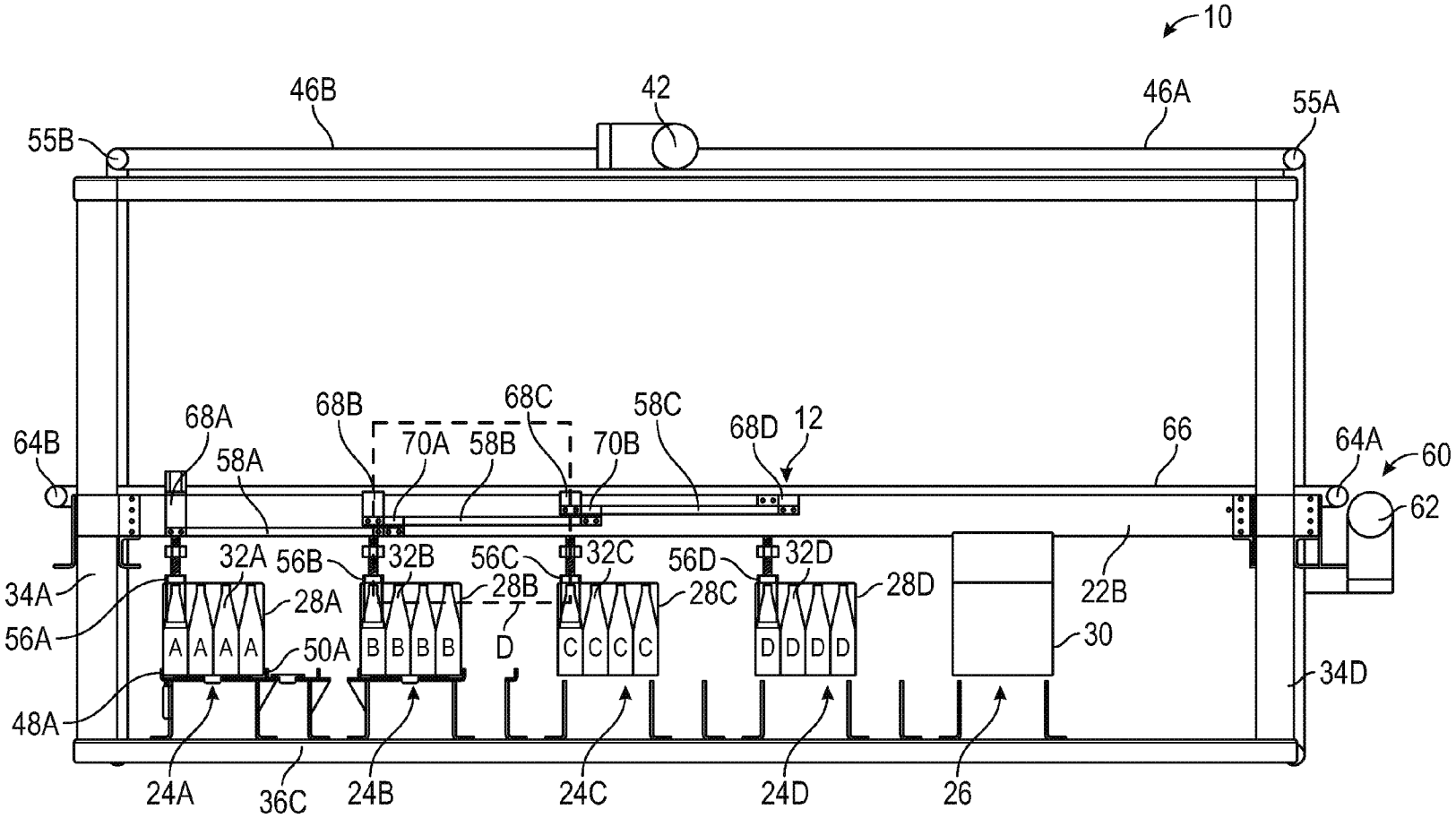
FIG. 3 is a front schematic view of the article selection and packaging system of FIG. 2 showing a boom of the boom system lowered to bring the plurality of grasping assemblies of the selection and packaging assembly into contact with articles within article housings disposed on the article housing conveyors.
Figure 4:
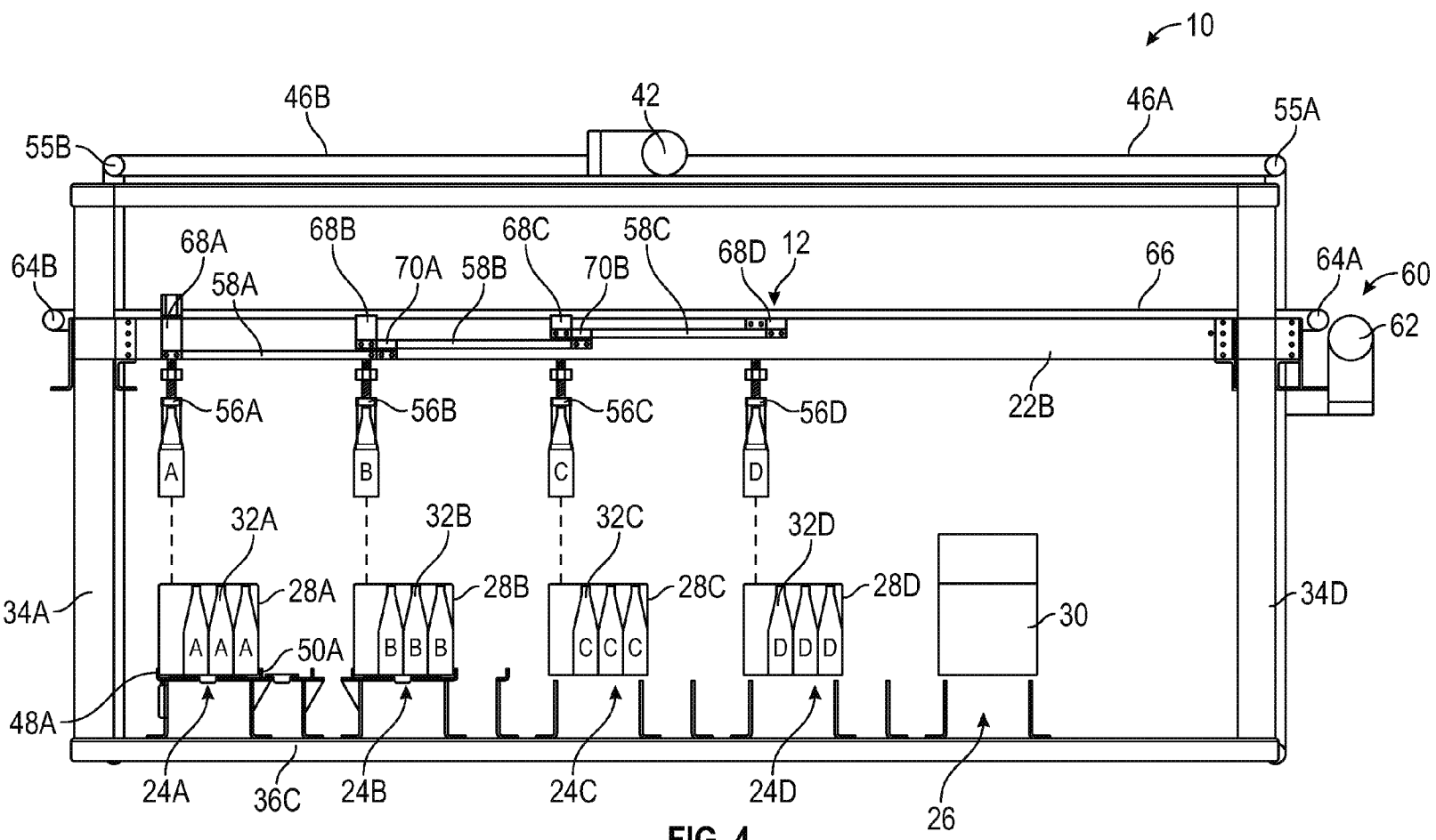
FIG. 4 is a front schematic view of the article selection and packaging system of FIG. 3 showing the boom raised and the plurality of grasping assemblies of the selection and packaging assembly each having at least one selected article.

As such, exemplary operation of article selection and packaging system 10 is summarized with reference to FIGS. 2-6. Starting at FIG. 2, elevator motor 42 is operated to lower boom 22 to bring grasping assemblies 56A-56D into contact with articles 32A-32B, as shown in FIG. 3. From the position of FIG. 3, grasping assemblies 56A-56B attach to one of articles 32A-32B, respectively, in preparation for withdrawal of articles 32A-32D from article housings 28A-28D. As shown in FIG. 4, boom 22 is raised using elevator motor 42 to extract one or more of articles 32A-32D from article housings 28A-28D. Drive motor 62 is operated to retract telescoping shuttles 58A-58C to the position of FIG. 5 to position grasping assemblies 56A-56D and the respective articles 32A-32B above composite article housing 30. Elevator motor 42 is operated to lower boom 22 to position articles 32A-32D within grasping assemblies 56A-56D into composite article housing 30, as shown in FIG. 6. The process may be repeated until composite article housing 30 is filled to capacity with an equal or different number of articles from article housings 28A-28D. Although operation of article selection and packaging system 10 has been described with reference to FIGS. 2-6 and the use of motors, belts and pulleys, other types of motive systems may be used, such as hydraulic systems, chain-driven systems, electrically actuated systems and the like.

FIG. 3 is a front schematic view of article selection and packaging system 10 of FIG. 2 showing boom 22 lowered to bring grasping assemblies 56A-56D of selection and packaging assembly 12 into contact with articles 32A-32D within article housings 28A-28D disposed on article housing conveyors 16A-16D, respectively. With telescoping shuttles 58A-58C positioned as depicted in FIG. 2, boom 22 is lowered using elevator motor 42 to engage grasping assemblies 56A-56D with articles 32A-32D, respectively, as shown in FIG. 3.

Figure 7:
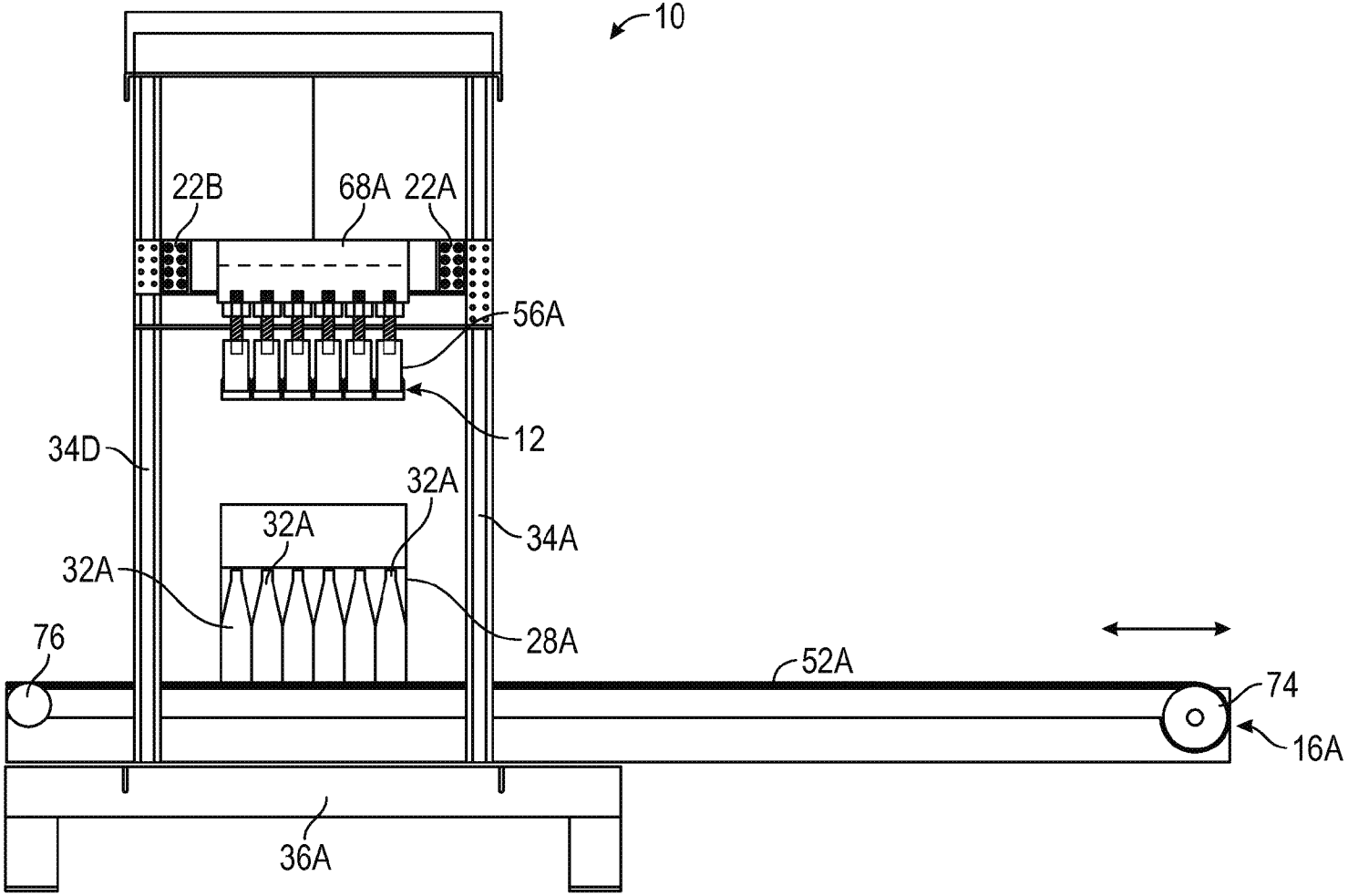
FIG. 7 is a side schematic view of an embodiment of the selecting and packaging assembly of FIG. 1 showing a plurality of grasping assemblies for one of the plurality of article housing conveyers.

Grasping assemblies 56A-56D comprise devises that attach to articles 32A-32D in order to allow articles 32A-32D to be removed from article housings 28A-28D. Grasping assemblies 56A-56D are configured to withdraw one of each of articles 32A-32D from article housings 28A-28D, respectively, or, as shown in FIG. 7, each of grasping assemblies 56A-56D may be configured to withdraw multiple articles 32A-32D from each of article housings 28A-28D, respectively. As such, grasping assemblies 56A-56D are configured to accept a portion of each article under downward force from boom 22, and are configured to hold onto each article as boom 22 is raised. In one embodiment, each of grasping assemblies 56A-56D comprises a suction coupler, claw, clamp, hook or the like. Thus, grasping assemblies 56A-56D may be coupled to other external systems, such as compressed air systems, suction systems and electrical systems. In various examples, articles 32A-32D comprise bottles having necks extending from a main container portion, and grasping assemblies 56A-56D are configured to attach to bottle-cap ends of the necks.

As shown in FIG. 3, grasping assemblies 56A-56D are configured to align with one of articles 32A-32D. Each of telescoping shuttles 58A-58C is sized based on the spacing distance D between article housing stations 24A-24D. For example, each of article housings 28A-28D may be configured to include a row of four articles 32A-32D, respectively. Telescoping shuttles 58A-58C are sized to allow grasping assemblies 56A-56D to grasp the leftmost (with respect to the orientation of FIGS. 2-6) one of articles 32A-32C. Telescoping shuttle 58A includes grasping assembly 56A and grasping assembly 56B, which are spaced along telescoping shuttle 58A an amount equal to, or approximately equal to (e.g., offset an amount to still allow grasping assemblies 56A and 56B to couple to articles 32A and 32B), the distance between the leftmost articles 32A and 32B.

FIG. 4 is a front schematic view of article selection and packaging system 10 of FIG. 3 showing boom 22 raised and grasping assemblies 56A-56D of selection and packaging assembly 12 each having a selected article 32A-32D.

As discussed above, movement of leading shuttle hitch 68A to the right causes telescoping shuttles 56A-56C to collapse or telescope into each other. Telescoping shuttles 56A-56C may have a variety of configurations to permit the telescoping action. In the described embodiment, telescoping shuttles 56A-56C comprise arms having a rectilinear tubular construction. In the described embodiment, shuttle hitches 68A-68D comprise upside down, U-shaped brackets that have sides connected to telescoping shuttles 56A-56C and tops that loop over drive mechanism conveyor 66. As such, telescoping shuttles 56A-56C slide within shuttle hitches 68A-68D. Telescoping shuttles 56A-56C are coupled to telescoping shuttles 56A-56C in any suitable manner, such as with fasteners, threaded fasteners, adhesive, welding, brazing or the like. Leading shuttle hitch 68A is anchored to drive mechanism conveyor 66 in any suitable manner, such with a clamp, fasteners or the like. In an example, shuttle couplers 70A and 70B also comprise upside down, U-shaped brackets that have sides connected to one of telescoping shuttles 56A-56C and tops that loop over another of telescoping shuttles 56A-56C. As such, telescoping shuttle 58B is slidable within shuttle coupler 70A, and telescoping shuttle 58C is slidable within shuttle coupler 70B. Although described with reference to particular embodiments, telescoping shuttles 56A-56C, shuttle hitches 68A-68D and shuttle couplers 70A and 70B can have other configurations that permit movement, telescoping or otherwise, via the drive mechanism, such as drive motor 62 and drive mechanism conveyor 66.

In various examples, boom 22 includes rails on which each of telescoping shuttles 56A-56C slide. In the illustrated example, a side surface of boom 22 shown in FIG. 4 may include horizontally extending and vertically stacked rails that couple to engagement features on a mating side surface of each of telescoping shuttles 58A-58C. In other examples, telescoping shuttles 58A-58C may be configured to slide on stacked rails; for example, telescoping shuttle 58B may be configured to slide on a rail on top of telescoping shuttle 58A, and telescoping shuttle 58C nay be configured to slide on a rail on top of telescoping shuttle 58B. In other examples, rails are not used and telescoping shuttles 56A-56C slid within each other without the use of external rails.

As shown in FIG. 4, each grasping assembly 56A-56D is attached to one of articles 32A-32D from each article housing 28A-28D, respectively. Operation of drive motor 62 causes drive motor conveyor 66 to gather telescoping shuttles 58A-58C by pulling leading telescoping shuttle 58A towards following telescoping shuttles 58B and 58C from the spread position of FIG. 4 to the collapsed, or telescopically gathered, position of FIG. 5 so that grasping mechanisms 56A-56D are gathered in a bunch formation for inserting of the grasped and selected articles 32A-32D into composite article housing 30.

FIG. 5 is a front schematic view of article selection and packaging system 10 of FIG. 4 showing telescoping shuttles 56A-56C retracted over composite article housing 30 disposed on composite article housing conveyor 18. FIG. 5 shows telescoping shuttles 56A-56C in a stacked, or telescopically gathered, configuration such that the grasped and selected articles 32A-32D of grasping assemblies 56A-56D are gathered or bunched. In various examples, telescoping shuttles 56A-56C, shuttle hitches 68A-68D and shuttle couplers 70A and 70B are sized, shaped and configured to facilitate stacking in such a manner that grasping assemblies 56A-56D will be positioned and spaced relative to each other and relative to composite article housing station 26 to allow the grasped and selected articles 32A-32D to be inserted into composite article housing 30. Thus, when telescoping shuttles 56A-56C are gathered by drive motor 62, grasping assemblies 56A-56D will be automatically positioned to allow boom 22 to be lowered to insert the selected, grasped and withdrawn articles 32A-32D into composite article housing 30. In an example, side rail 38B includes shuttle bumper 72 that engages one or more of shuttle hitches 68A-68D and shuttle couplers 70A and 70B of telescoping shuttles 58A-58C in the retracted position. Shuttle bumper 72 is used in various embodiments to precisely position bunched grasping assemblies 56A-56D over composite article housing 30. Thus, shuttle bumper 72 is used to adjust or compensate for the distance between side rail 38B or posts 34C and 34D and composite article housing station 26, and to arrest the movement of telescoping shuttles 58A-58C in the retracted position. In various examples, bumper 72 is made of a resilient material, such as rubber and the like.

FIG. 6 is a front schematic view of article selection and packaging system 10 of FIG. 5 showing boom 22 lowered to place selected articles 32A-32D in composite article housing 30.

Shuttle hitches 68A-68D are sized to be brought together in the gathered position to have a total width that is close to the width of composite article housing 30. As such, the selected articles 32A-32D are placed in position in composite article housing 30 directly between side walls of composite article housing 30, with the selected articles 32A, 32B, 32C and 32D being spaced approximately evenly across composite article housing 30. Grasping assemblies 56A-56D are actuated to release articles 32A-32D into composite article housing 30 while shuttle hitches 68A-68D are positioned over composite article housing 30.

After delivery of articles 32A-32D in the gathered configuration to composite article housing station 26, selection and packing assembly 12 is operated to repeat the process and select additional articles 32A-32D from article housings 28A-28D, respectively, for positioning within composite article housing 30 adjacent the previously selected and packed articles 32A-32D.

In particular, boom 22 is raised via elevator motor 42. Elevator motor 42 is driven in an opposite direction as compared to when lowering boom 22 in order to raise boom 22. Next, drive motor 62 is operated to extend telescoping shuttles 58A-58C. In particular, drive motor 62 for article selection and packing assembly 12 moves in an opposite direction as compared to when retracting telescoping shuttles 58A-58C into the gathered position in order to reposition grasping assemblies 56A-56D above article housings 28A-28D, respectively.

Leading telescoping shuttle 58A telescopes apart from the other telescoping shuttles 58B and 58C and moves toward posts 34A and 34B (FIG. 1). Leading shuttle coupler 70A engages with following shuttle hitch 68B of adjacent following telescoping shuttle 58B and telescopically moves following telescoping shuttle 58B relative to the other following telescoping shuttle 58C. Continued movement of drive motor 62 spreads telescoping shuttles 58A-58C apart and repositions at least grasping assemblies 56A-56D relative to the respective article housing stations 24A-24D for selection and withdrawal of additional articles 32A-32D.

Telescoping shuttles 58A-58C are configured to be fully extended before leading telescoping shuttle 58A reaches a distal-most portion of article housing 28A. As such, grasping assemblies 56A-56D may be positioned over any lateral portion of article housings 28A-28D to withdraw articles 32A-32D. For example, grasping assembly 56A of leading telescoping shuttle 58A is positioned over the next article 32A remaining in article housing 28A. Offsetting of leading telescoping shuttle 58A for grasping of the next article 32A corresponding offsets the other telescoping shuttles 58B and 58C and grasping assemblies 56B-56D, such as by not fully extending telescoping shuttles 58A-58C toward posts 34A and 34B as far as previously done to retrieve other articles 32A-32D, for grasping of the next articles 32B-32D to be selected.

This process may be repeated for each row of articles 32A-32D in each article housing 28A-28D. For adjacent rows of articles 32A-32D in each article housing 28A-28D (e.g., those further into the plane of FIG. 6), article housing conveyors 16A-16D are activated to advance article housings 28A-28D toward (e.g., out of the plane of FIG. 6) grasping assemblies 56A-56D. Additionally, grasping assemblies 56A-56D may be configured to attach to multiple rows of articles 32A-32D within each of article housings 28A-28D, as shown in FIG. 7.

FIG. 7 is a side schematic view of an embodiment of selecting and packaging assembly 12 of FIG. 1 showing a plurality of grasping assemblies 56A for article housing station 24A. Article housing conveyor 16A includes belt 52A, which is be driven by motor 74 and rotated on pulley 76.

Posts 34A and 34B extend from stabilizer member 36A to support boom 22. Shuttle hitch 68A is positioned between spans 22A and 22B of boom 22 to support a plurality of grasping assemblies 56A. Grasping assemblies 56A extend longitudinally, with respect to the orientation of article housing station 24A so as to reach multiple rows of articles 32A extending longitudinally across a portion of the span of belt 52A in article housing 28A. In the illustrated embodiment, shuttle hitch 68A includes six grasping assemblies 56A to reach six rows of articles 32A. In examples, shuttle hitches 68B-68D may also be configured to include a plurality of grasping assemblies 56B-56D, respectively, similar to what is shown in FIG. 7. However, in other examples more or fewer grasping assemblies may be included in each of shuttle hitches 68A-68D. As such, article housings 28A-28D may be emptied more rapidly as compared to shuttle hitches 68A-68D including only a single one of grasping assemblies 56A-56D. With the configuration of FIG. 7, and similar configurations, article housing conveyers 16A-16D do not need to be operated to advance article housings 28A-28D in order to allow grasping assemblies 56A-56D to reach additional rows of articles 32A-32D in the longitudinal direction.

As an example, each article container 28A-28D may be configured to hold twenty-four of each of articles 32A-32D, respectively, in six longitudinal rows of four latera articles. If each of shuttle hitches 68A-68D includes only one of grasping assemblies 56A-56D, respectively, selecting and packaging assembly 12 would need to make four telescoping movements of telescoping shuttles 58A-58D for each of the six rows, with article housing conveyers 16A-16D needing to be advanced six times to allow grasping assemblies 56A-56D to reach each row, thereby totaling twenty-four telescoping movements of telescoping shuttles 58A-58D.

If, however, each of shuttle hitches 68A-68D includes six of grasping assemblies 56A-56D as shown in FIG. 7, selecting and packaging assembly 12 would only need to make four total telescoping movements of telescoping shuttles 58A-58D to empty all of article housings 28A-28D and article housing conveyers 16A-16D would not need to be advanced at all.

After article housings 28A-28D have been emptied, article housing conveyers 16A-16D are be advanced to remove the empty article housings 28A-28D from being underneath grasping assemblies 56A-56D and to position additional article housings 28A-28D that are full of articles 32A-32D underneath grasping assemblies 56A-56D. An additional empty composite article housing 30 may be loaded onto composite article housing conveyer 18 and positioned in composite article housing station 26 so the process can be repeated.

VARIOUS NOTES & EXAMPLES

Example 1 can include subject matter, such as can include an article selection and packing system comprising: at least two article housing stations; a composite article housing station spaced from the at least two article housing stations; a boom extending over the at least two article housing stations and the composite article housing station; and a selection and packing assembly extending between the at least two article housing stations and the composite article housing station, the selection and packing assembly including: at least two telescoping shuttles, the at least two telescoping shuttles movably coupled along the boom, and at least two grasping assemblies coupled with the at least two telescoping shuttles, respectively, the at least two grasping assemblies each configured to withdraw one or more articles from the at least two article housing stations, respectively, and pack the withdrawn one or more articles together at the composite article housing station.

Example 2 can include, or can optionally be combined with the subject matter of Example 1, to optionally include wherein the at least two article housing stations and the composite article housing stations are each configured to hold a plurality of articles including beverage containers.

Example 3 can include, or can optionally be combined with the subject matter of one or any combination of Examples 1 or 2 to optionally include wherein the at least two grasping assemblies are movable between a gathered delivery configuration at the composite article housing station and a spread selection configuration at respective article housing stations according to positioning of the at least two telescoping shuttles between respective telescopically gathered and telescopically spread configurations.

Example 4 can include, or can optionally be combined with the subject matter of one or any combination of Examples 1-3 to optionally include wherein one or more of the at least two telescoping shuttles includes: a shuttle arm, a shuttle hitch at a first end portion of the shuttle arm, and a shuttle coupler at a second end portion of the shuttle arm, wherein the shuttle hitch and the shuttle coupler are spaced apart by the shuttle arm based on spacing between the at least two article housing stations.

Example 5 can include, or can optionally be combined with the subject matter of one or any combination of Examples 1-4 to optionally include wherein the at least two telescoping shuttles include first and second telescoping shuttles and the at least two grasping assemblies including first and second grasping assemblies, and the shuttle hitch of the first telescoping shuttle engages with the second telescoping shuttle to gather the first and second grasping assemblies in a gathered delivery configuration.

Example 6 can include, or can optionally be combined with the subject matter of Examples 1-5 to optionally include wherein the at least two telescoping shuttles include first and second telescoping shuttles and the at least two grasping assemblies include first and second grasping assemblies, and the shuttle coupler of the first telescoping shuttle engages with the second telescoping shuttle to spread apart the first and second grasping assemblies in a spread selection configuration.

Example 7 can include, or can optionally be combined with the subject matter of Examples 1-6 to optionally include a drive mechanism, the drive mechanism coupled with at least one shuttle hitch of the at least two telescoping shuttles.

Example 8 can include, or can optionally be combined with the subject matter of Examples 1-7 to optionally include wherein the at least two telescoping shuttles include a leading telescoping shuttle statically held relative to the drive mechanism, and the second telescoping shuttle is a following telescopic shuttle movable relative to the drive mechanism.

Example 9 can include, or can optionally be combined with the subject matter of Examples 1-8 to optionally include wherein one or more of the at least two telescoping shuttles includes a shuttle arm, and the at least two article housing stations are spaced according to a length of the shuttle arm.

Example 10 can include, or can optionally be combined with the subject matter of Examples 1-9 to optionally include a boom frame, and the boom is movably coupled along the boom frame.

Example 11 can include, or can optionally be combined with the subject matter of Examples 1-10 to optionally include an elevator mechanism coupled with the boom, and the elevator mechanism is configured to lower and raise at least the boom and the at least two or more grasping assemblies relative to the article housing stations and the composite article housing station.

Example 12 can include, or can optionally be combined with the subject matter of Examples 1-11 to optionally include an article selection and packing assembly comprising: a boom extending from a first boom end to a second boom end; a drive mechanism coupled with the boom; a selection and packing assembly coupled with the boom, the selection and packing assembly includes: a leading telescoping shuttle movably coupled with the boom, a following telescoping shuttle movably coupled with the boom and telescopically coupled with the leading telescoping shuttle, a plurality of grasping assemblies including at least a first grasping assembly coupled with the leading telescoping shuttle and a second grasping assembly coupled with the following telescoping shuttle, and wherein the drive mechanism is coupled with the leading telescoping assembly and movement of the drive mechanism in a first direction telescopically gathers the leading and following telescoping shuttles together while gathering the first and second grasping assemblies together.

Example 13 can include, or can optionally be combined with the subject matter of Examples 1-12 to optionally include wherein movement of the drive mechanism in a second direction telescopically spreads the leading and following telescoping shuttles apart while the first and second grasping assemblies are spread apart.

Example 14 can include, or can optionally be combined with the subject matter of Examples 1-13 to optionally include at least two article housing stations and a composite article housing station, and wherein the selection and packing assembly is configured to withdraw articles from the at least two article housing stations with the leading and following telescoping shuttles in a telescopically spread configuration and deliver the articles to the composite article housing station with the telescoping shuttles in a telescopically gathered configuration.

Example 15 can include, or can optionally be combined with the subject matter of Examples 1-14 to optionally include wherein at least the leading telescoping shuttle includes: a shuttle arm, a shuttle hitch at a first end portion of the shuttle arm, and a shuttle coupler at a second end portion of the shuttle arm, wherein the shuttle hitch and the shuttle coupler are spaced apart by the shuttle arm based on spacing between the at least two article housing stations.

Example 16 can include, or can optionally be combined with the subject matter of Examples 1-15 to optionally include wherein the shuttle hitch of the leading telescoping shuttle engages with the following telescoping shuttle to gather the first and second grasping assemblies in a gathered delivery configuration.

Example 17 can include, or can optionally be combined with the subject matter of Examples 1-16 to optionally include wherein the shuttle coupler of the leading telescoping shuttle engages with the following telescoping shuttle to spread apart the first and second grasping assemblies in a spread selection configuration.

Example 18 can include, or can optionally be combined with the subject matter of Examples 1-17 to optionally include a drive mechanism, the drive mechanism statically coupled with the leading telescoping shuttle.

Example 19 can include, or can optionally be combined with the subject matter of Examples 1-18 to optionally include wherein the following telescoping shuttle is movable relative to the drive mechanism.

Example 20 can include, or can optionally be combined with the subject matter of Examples 1-19 to optionally include a boom frame, and the boom is movably coupled along the boom frame.

Example 21 can include, or can optionally be combined with the subject matter of Examples 1-20 to optionally include an elevator mechanism coupled with the boom, and the elevator mechanism is configured to lower and raise at least the boom and the at least two or more grasping assemblies relative to the boom frame.

Example 22 can include, or can optionally be combined with the subject matter of Examples 1-21 to optionally include a method for selecting and packing articles comprising: positioning a plurality of first articles at a first article housing station; positioning a plurality of second articles at a second article housing station; and selecting and packing articles from each of the first and second plurality of articles at a composite article housing station, selecting and packing comprising: withdrawing at least one first article of the plurality of first articles at the first article housing station with a first grasping assembly, withdrawing at least one second article of the plurality of second articles at the second article housing station with a second grasping assembly, gathering the first and second grasping assemblies and the withdrawn first and second articles into a gathered delivery configuration with at least two telescoping shuttles, and delivering the withdrawn at least one first and second articles in the gathered delivery configuration to the composite article housing station.

Example 23 can include, or can optionally be combined with the subject matter of Examples 1-22 to optionally include wherein positioning the plurality of first and second articles includes moving first and second article housings into the first and second article housing stations along corresponding conveyors.

Example 24 can include, or can optionally be combined with the subject matter of Examples 1-23 to optionally include wherein withdrawing the at least one first article and the at least one second article includes raising a boom coupled with the first and second grasping assemblies toward the first and second pluralities of articles.

Example 25 can include, or can optionally be combined with the subject matter of Examples 1-24 to optionally include wherein gathering the first and second grasping assemblies and the first and second articles into the gathered delivery configuration includes telescopically gathering the at least two telescoping shuttles together.

Example 26 can include, or can optionally be combined with the subject matter of Examples 1-25 to optionally include wherein the at least two telescoping shuttles include at least a leading telescoping shuttle and a following telescoping shuttle, and gathering the first and second grasping assemblies and the first and second articles into the gathered delivery configuration includes: moving the leading telescoping shuttle toward the composite article housing station, engaging the leading telescoping shuttle with the following telescoping shuttle, telescopically gathering the leading and telescoping shuttles together, and moving the telescopically gathered leading and telescoping shuttles toward the composite article housing station.

Example 27 can include, or can optionally be combined with the subject matter of Examples 1-26 to optionally include spreading the first and second grasping assemblies into a spread selection configuration after delivery of the first and second articles to the composite article housing station, the spreading includes telescopically spreading apart the at least two telescoping shuttles.

Example 28 can include, or can optionally be combined with the subject matter of Examples 1-27 to optionally include wherein the at least two telescoping shuttles include at least a leading telescoping shuttle and a following telescoping shuttle, and spreading the first and second grasping assemblies into the spread selection configuration includes: moving the leading telescoping shuttle away from the composite article housing station, engaging a leading shuttle coupler of the leading telescoping shuttle with the following telescoping shuttle, telescopically spreading the leading and telescoping shuttles apart, and moving the telescopically spread leading and telescoping shuttles toward the first and second article housing stations, respectively.

Example 29 can include, or can optionally be combined with the subject matter of Examples 1-28 to optionally include repeating selecting and packing articles from each of the first and second pluralities of articles, and filling a composite article housing at the composite article housing station according to the selecting and packing of articles.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. An article selection and packing system comprising:

at least two article housing stations;

a composite article housing station spaced from the at least two article housing stations;

a boom extending over the at least two article housing stations and the composite article housing station; and a selection and packing assembly extending between the at least two article housing stations and the composite article housing station, the selection and packing assembly including:

at least two telescoping shuttles, the at least two telescoping shuttles movably coupled along the boom, and at least two grasping assemblies coupled with the at least two telescoping shuttles, respectively, the at least two grasping assemblies each configured to withdraw one or more articles from the at least two article housing stations in a spread configuration with the at least two grasping assemblies spaced from each other, respectively, and pack the withdrawn one or more articles together at the composite article housing station in a gathered configuration with the at least two grasping assemblies gathered and the at the least two telescoping shuttles telescopically gathered.

2. The system of claim 1, wherein the at least two article housing stations and the composite article housing stations are each configured to hold a plurality of articles including beverage containers.

3. The system of claim 1, wherein the at least two grasping assemblies are movable between the gathered configuration at the composite article housing station and the spread configuration at respective article housing stations according to positioning of the at least two telescoping shuttles between respective telescopically gathered and telescopically spread configurations.

4. The system of claim 1, wherein one or more of the at least two telescoping shuttles includes:

a shuttle arm, a shuttle hitch at a first end portion of the shuttle arm, and a shuttle coupler at a second end portion of the shuttle arm, wherein the shuttle hitch and the shuttle coupler are spaced apart by the shuttle arm based on sp acing between the at least two article housing stations.

5. The system of claim 4, wherein the at least two telescoping shuttles include first and second telescoping shuttles and the at least two grasping assemblies including first and second grasping assemblies, and the shuttle hitch of the first telescoping shuttle engages with the second telescoping shuttle to gather the first and second grasping assemblies in a gathered delivery configuration.

6. The system of claim 4, wherein the at least two telescoping shuttles include first and second telescoping shuttles and the at least two grasping assemblies include first and second grasping assemblies, and the shuttle coupler of the first telescoping shuttle engages with the second telescoping shuttle to spread apart the first and second grasping assemblies in a spread selection configuration.

7. The system of claim 4 comprising a drive mechanism, the drive mechanism coupled with at least one shuttle hitch of the at least two telescoping shuttles.

8. The system of claim 4, wherein the at least two telescoping shuttles include a leading telescoping shuttle statically held relative to the drive mechanism, and the second telescoping shuttle is a following telescopic shuttle movable relative to the drive mechanism.

9. The system of claim 1, wherein one or more of the at least two telescoping shuttles includes a shuttle arm, and the at least two article housing stations are spaced according to a length of the shuttle arm.

10. The system of claim 1 comprising a boom frame, and the boom is movably coupled along the boom frame.

11. The system of claim 1 comprising an elevator mechanism coupled with the boom, and the elevator mechanism is configured to lower and raise at least the boom and the at least two or more grasping assemblies relative to the article housing stations and the composite article housing station.

12. An article selection and packing assembly comprising:

a boom extending from a first boom end to a second boom end;

a drive mechanism coupled with the boom;

a selection and packing assembly coupled with the boom, the selection and packing assembly includes:

a leading telescoping shuttle movably coupled with the boom, a following telescoping shuttle movably coupled with the boom and telescopically coupled with the leading telescoping shuttle, a plurality of grasping assemblies including at least a first grasping assembly coupled with the leading telescoping shuttle and a second grasping assembly coupled with the following telescoping shuttle, and wherein the drive mechanism is coupled with the leading telescoping assembly and movement of the drive mechanism in a first direction telescopically gathers the leading and following telescoping shuttles together while gathering the first and second grasping assemblies together.

13. The assembly of claim 12, wherein movement of the drive mechanism in a second direction telescopically spreads the leading and following telescoping shuttles apart while the first and second grasping assemblies are spread apart.

14. The assembly of claim 12 comprising at least two article housing stations and a composite article housing station, and wherein the selection and packing assembly is configured to withdraw articles from the at least two article housing stations with the leading and following telescoping shuttles in a telescopically spread configuration and deliver the articles to the composite article housing station with the telescoping shuttles in a telescopically gathered configuration.

15. The assembly of claim 12, wherein at least the leading telescoping shuttle includes:

a shuttle arm, a shuttle hitch at a first end portion of the shuttle arm, and a shuttle coupler at a second end portion of the shuttle arm, wherein the shuttle hitch and the shuttle coupler are spaced apart by the shuttle arm based on sp acing between the at least two article housing stations.

16. The assembly of claim 15, wherein the shuttle hitch of the leading telescoping shuttle engages with the following telescoping shuttle to gather the first and second grasping assemblies in a gathered delivery configuration.

17. The system of claim 15, wherein the shuttle coupler of the leading telescoping shuttle engages with the following telescoping shuttle to spread apart the first and second grasping assemblies in a spread selection configuration.

18. The system of claim 15 comprising a drive mechanism, the drive mechanism statically coupled with the leading telescoping shuttle.

19. The system of claim 18, wherein the following telescoping shuttle is movable relative to the drive mechanism.

20. The system of claim 12 comprising a boom frame, and the boom is movably coupled along the boom frame.

21. The system of claim 20 comprising an elevator mechanism coupled with the boom, and the elevator mechanism is configured to lower and raise at least the boom and the at least two or more grasping assemblies relative to the boom frame.

22. A method for selecting and packing articles comprising:

positioning a plurality of first articles at a first article housing station;

positioning a plurality of second articles at a second article housing station; and selecting and packing articles from each of the first and second plurality of articles at a composite article housing station, selecting and packing comprising:

withdrawing at least one first article of the plurality of first articles at the first article housing station with a first grasping assembly, withdrawing at least one second article of the plurality of second articles at the second article housing station with a second grasping assembly, gathering the first and second grasping assemblies and the withdrawn first and second articles into a gathered delivery configuration with at least two telescoping shuttles, the at least two telescoping shuttles telescopically gathered together in the gathered delivery configuration, and delivering the withdrawn at least one first and second articles in the gathered delivery configuration to the composite article housing station.

23. The method of claim 22, wherein positioning the plurality of first and second articles includes moving first and second article housings into the first and second article housing stations along corresponding conveyors.

24. The method of claim 22, wherein withdrawing the at least one first article and the at least one second article includes raising a boom coupled with the first and second grasping assemblies toward the first and second pluralities of articles.

25. The method of claim 22, wherein the at least two telescoping shuttles include at least a leading telescoping shuttle and a following telescoping shuttle, and gathering the first and second grasping assemblies and the first and second articles into the gathered delivery configuration includes:

moving the leading telescoping shuttle toward the composite article housing station, engaging the leading telescoping shuttle with the following telescoping shuttle, telescopically gathering the leading and telescoping shuttles together, and moving the telescopically gathered leading and telescoping shuttles toward the composite article housing station.

26. The method of claim 22 comprising spreading the first and second grasping assemblies into a spread selection configuration after delivery of the first and second articles to the composite article housing station, the spreading includes telescopically spreading ap art the at least two telescoping shuttles.

27. The method of claim 26, wherein the at least two telescoping shuttles include at least a leading telescoping shuttle and a following telescoping shuttle, and spreading the first and second grasping assemblies into the spread selection configuration includes:

moving the leading telescoping shuttle away from the composite article housing station, engaging a leading shuttle coupler of the leading telescoping shuttle with the following telescoping shuttle, telescopically spreading the leading and telescoping shuttles apart, and moving the telescopically spread leading and telescoping shuttles toward the first and second article housing stations, respectively.

28. The method of claim 22 comprising:

repeating selecting and packing articles from each of the first and second pluralities of articles, and filling a composite article housing at the composite article housing station according to the selecting and packing of articles.

* * * * *